US007784904B2

(12) United States Patent
Ide et al.

(10) Patent No.: US 7,784,904 B2
(45) Date of Patent: Aug. 31, 2010

(54) LIQUID JET HEAD

(75) Inventors: Shuichi Ide, Tokyo (JP); Mineo Kaneko, Tokyo (JP); Ken Tsuchii, Sagamihara (JP); Toru Yamane, Yokohama (JP); Masaki Oikawa, Inagi (JP); Keiji Tomizawa, Yokohama (JP); Mitsuhiro Matsumoto, Yokohama (JP); Kansui Takino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 12/197,668

(22) Filed: Aug. 25, 2008

(65) Prior Publication Data

US 2009/0066752 A1 Mar. 12, 2009

(30) Foreign Application Priority Data

Aug. 31, 2007 (JP) ..... 2007-225695

(51) Int. Cl.
*B41J 2/145* (2006.01)
*B41J 2/15* (2006.01)

(52) U.S. Cl. ..... 347/40; 347/65

(58) Field of Classification Search ..... 347/20, 347/40–43, 65, 71

See application file for complete search history.

(56) References Cited

U.S. PATENT DOCUMENTS

| | | | | |
|---|---|---|---|---|
| 5,218,376 | A | 6/1993 | Asai | |
| 5,677,718 | A * | 10/1997 | Crawford et al. | 347/92 |
| 6,155,673 | A | 12/2000 | Nakajima et al. | |
| 6,592,202 | B2 | 7/2003 | Udagawa et al. | |
| 6,652,079 | B2 | 11/2003 | Tsuchii et al. | |
| 6,830,317 | B2 * | 12/2004 | Tsuchii et al. | 347/56 |
| 6,964,467 | B2 | 11/2005 | Kaneko et al. | |
| 2007/0206065 | A1 | 9/2007 | Tomizawa et al. | |
| 2008/0055368 | A1 | 3/2008 | Oikawa et al. | |
| 2008/0136872 | A1 | 6/2008 | Tsuchii et al. | |

FOREIGN PATENT DOCUMENTS

| | | |
|---|---|---|
| JP | 54-161935 | 12/1979 |
| JP | 61-185455 | 8/1986 |
| JP | 61-249768 | 11/1986 |
| JP | 4-10941 | 1/1992 |
| JP | 2002-321369 | 11/2002 |

* cited by examiner

*Primary Examiner*—Thinh H Nguyen
(74) *Attorney, Agent, or Firm*—Fitzpatrick, Cella, Harper & Scinto

(57) ABSTRACT

A liquid ejecting head includes a plurality of nozzles, each including an ejection outlet for ejecting a droplet, an ejection energy generating element, disposed at a position opposing the ejection outlet, for generating energy for ejecting a droplet, a pressure chamber provided with the ejection energy generating element and fluidly communicating with the ejection outlet, and a supply passage for supplying the liquid to the pressure chamber. The nozzles include a first nozzle and a second nozzle, which are connected with respective supply passages having lengths different from each other. The first nozzle and the second nozzle are disposed at one end portion with respect to a widthwise direction of an elongated supply chamber for supplying the liquid to the first nozzle. The supply passage for the first nozzle extends in a direction perpendicular to a direction of liquid ejection from the ejection outlet and fluidly communicates with the supply chamber, and wherein the supply passage for the second nozzle extends in a direction parallel with the direction of liquid ejection.

12 Claims, 11 Drawing Sheets

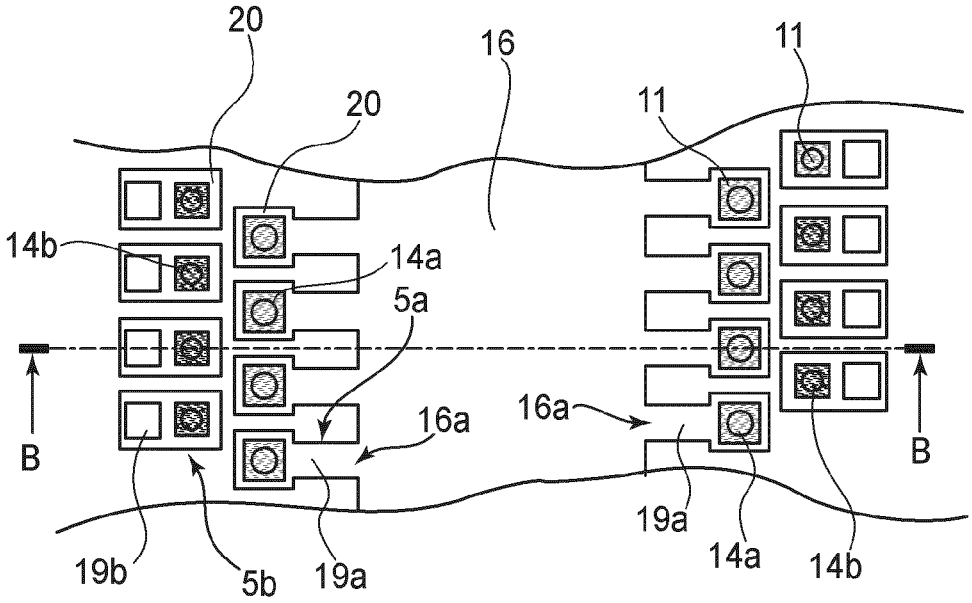
FIG.4A
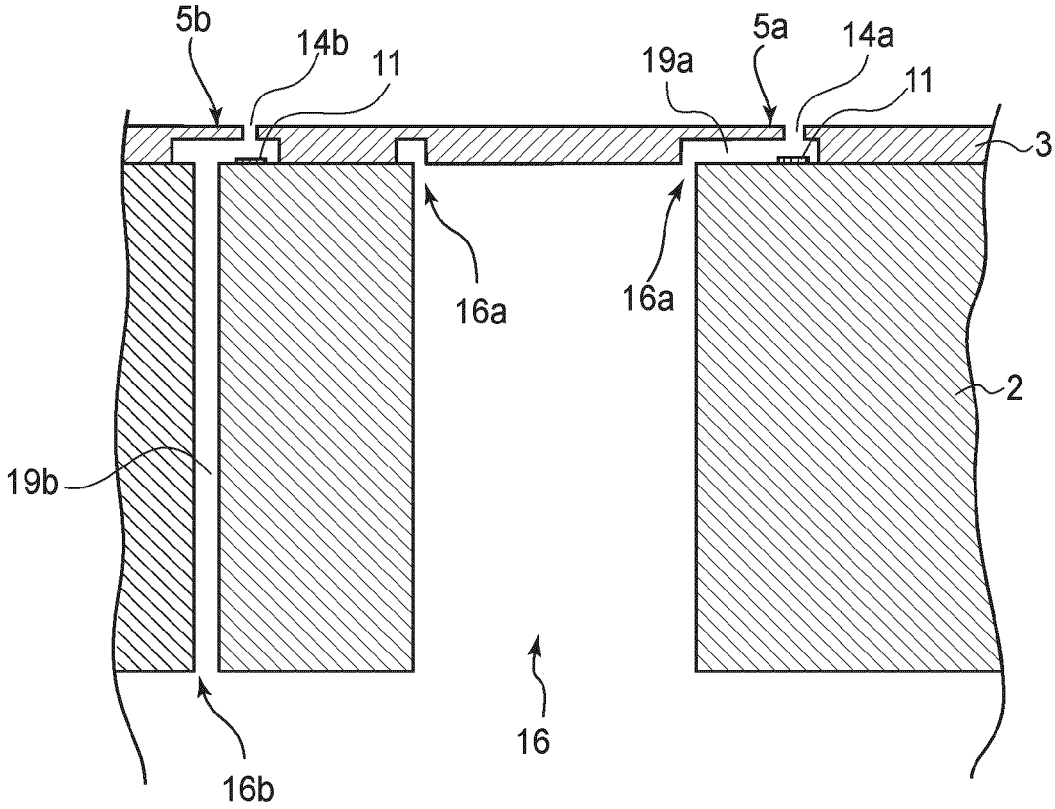
FIG.4B (B-B)

(G-G)

LIQUID JET HEAD

FIELD OF THE INVENTION AND RELATED ART

The present invention relates to a liquid jet head for jetting liquid such as ink.

In recent years, demand has been increasing for a recording apparatus which is significantly higher in speed, resolution, and image quality, and also, lower in noise than a conventional recording apparatus. One of the recording apparatuses which can satisfy such demand is an ink jet recording apparatus. An ink jet recording apparatus is structured to record an image on recording paper by jet droplets of ink (recording liquid) from its recording head so that the droplets of ink fly to the recording paper and adhere to the surface of the recording paper.

Generally, an ink jet recording apparatus employs energy generating elements as the means for jetting droplets of ink. Among various energy generating elements usable as the means for ejecting droplets of ink, an electrothermal transducer, such as a heater, and an electromechanical transducer, such as a piezoelectric element, have been widely used. Both means can be controlled in their ink ejecting operation, by controlling the electric signals supplied thereto. The principle, on which the ink ejecting method which uses an electrothermal transducer is based, is as follows: As voltage is applied to an electrothermal transducer, the body of ink, which is in contact with the electrothermal transducer, instantaneously boils, that is, a bubble (bubbles) is generated (body of ink changes in phase), suddenly increasing the pressure in the adjacencies of the electrothermal transducer. As a result, an ink droplet (ink droplets) is jetted out of the ink ejecting head through a nearby opening of the head. The principle on which the ink ejecting method which uses an electromechanical transducer (piezoelectric element) is based, is as follows: As voltage is applied to a piezoelectric element, the element displaces, suddenly increasing the pressure in the adjacencies of the electro-mechanical transducer. As a result, an ink droplet (droplets) is jetted out of a nearby opening of the head by the pressure generated by the displacement of the element.

The ink ejecting method which employs an electrothermal transducer as the ink ejecting energy generating element has merit in that it does not require a large amount of space, that it allows a recording head to be simple in structure, and also, that it makes easier to dispose a large number of ink ejecting nozzles in a small space. On the other hand, this ink ejecting method suffers from problems peculiar thereto. One of them is that the heat generated by an electrothermal transducer accumulates in a recording head, which results in the change in the volume of the ink droplet which an ink jet recording head jets. Another problem is that the electrothermal transducer is affected by the impact attributable to the collapsing of a bubble; the electrothermal transducer suffers from cavitation. Further, this ink ejecting method is problematic in that the air having dissolved into ink would reappear, as air bubbles, in the recording head, affecting thereby the ink jet recording head in terms of ink ejecting performance and image quality.

There are various methods for solving the above-described problems. Some of them are disclosed in the following documents:

Document 1: Japanese Laid-open Patent Application S54-161935

Document 2: Japanese Laid-open Patent Application S61-185455

Document 3: Japanese Laid-open Patent Application S61-249768

Document 4: Japanese Laid-open Patent Application H04-10941

They are related to a recording method based on ink jet, and an ink jet recording head. More specifically, the ink ejecting methods disclosed in the abovementioned Documents are characterized in that the ink jet head is structured so that the bubbles generated by driving an electrothermal transducer with a recording signal are allowed to escape into the atmosphere (ambient air). The Documents claim that the employment of the ink jet recording methods disclosed therein makes it possible to provide an ink jet recording head which is significantly more stable in ink droplet volume, significantly smaller in ink droplet volume, and significantly higher in the ink droplet ejecting speed than an ink jet recording head in accordance with the prior art. Further, they claim that they can prevent cavitation from occurring when the bubble collapses, and therefore, can improve an ink jet recording head in the length of its service life. Moreover, they claim that the employment of the ink jet recording methods disclosed therein can provide an ink jet recording head which is significantly higher in resolution than an ink jet recording apparatus in accordance with the prior art.

The structure of the ink jet recording heads disclosed in the abovementioned Documents are characterized in that in order to allow the bubbles to escape into the atmosphere, the minimum distance between an electrothermal transducer for generating a bubble (bubbles), and the corresponding nozzle, through which ink is jetted out, is rendered significantly smaller than that in an ink jet recording head in accordance with the prior art.

FIGS. 12A-12C show one of the typical forms of the nozzle of an ink jet printing head in accordance with the conventional art. FIG. 12A is a phantom plan view of the ink jet recording head in accordance with the prior art, as seen from the direction perpendicular to the substrate of the ink jet recording head, and FIG. 12B is a sectional view of the ink jet recording head, at a plane F-F shown in FIG. 12A. FIG. 12C is a sectional view of the ink jet recording head, at a plane G-G shown in FIG. 12A.

To describe the structure of an ink jet recording head of the above described type, the ink jet recording head is made up of a substrate 102, heaters 111, an ink passage plate 103 (orifice plate). Each heater 111 is an electrothermal transducer for ejecting ink, and is on the substrate 102. The ink passage plate 103 is joined with the substrate 102 to form ink passages. The ink passage plate 103 has: multiple passages, through which ink flows; a common ink chamber 116, from which ink flows to each of the multiple ink passages; and multiple holes 114 (outward end portion of nozzle) FIGS. 12A-12C, through which ink droplets are jetted out of the recording head. Each nozzle has: a bubble generation chamber 120, in which a bubble is generated by the heater 111; and an ink passage 119 (dedicated ink passage) through which ink is delivered to the bubble generation chamber 120. The heater 111 is on the bottom surface of the bubble generation chamber 120 (which is part of top surface of substrate 102). The substrate 102 has an ink supply chamber (common ink chamber), which is for supplying each of the dedicated ink passages 119 with ink from the back side of the substrate 102, that is, the opposite side of the substrate 102 from the primary surface (top surface), that is, the side which is in contact with the ink passage plate 103. Further, the ink passage plate 103 is provided with ink ejection outlets 114, which oppose the heaters 111 on the substrate 102, one for one.

The operation of the recording head structured as described above is as follows: The ink supplied to the common ink chamber is supplied to the bubble generation chamber 120 through the dedicated ink passage 119 of each nozzle, and fills up the bubble generation chamber 120. The ink in the bubble generation chamber 120 is jetted in the direction which is roughly perpendicular to the primary surface of the substrate 102, by a bubble (bubbles) which generates as the ink is instantaneously boiled (film boiling) by the heater 111. As the ink is jetted out of the ink ejection outlet 114, it flies away in the form of an ink droplet.

Currently, it is desired that when an ink jet printer is used to record on ordinary paper or the like, the printer records at a high speed, whereas when it is used to record on special purpose paper, such as glossy paper, it records at a high level of image quality. One of the methods for forming a high quality image at a high speed is to employ an ink jet recording head, which remains relatively large in ink droplet volume even when it is recording at a high speed. As the means for realizing a high speed printer, such as the one described above, there are a method which increases an ink jet printing head in the nozzle response speed, and a method which increases an ink jet head in nozzle count by disposing nozzles at higher density.

One of the known methods for disposing multiple nozzles at a high density is to dispose the ink ejection outlets 114 in a zigzag pattern as shown in FIGS. 13A and 13B. FIG. 13A is a phantom plan view of a part of the ink jet recording head, as seen from the direction perpendicular to the primary surface of the substrate, and FIG. 13B is a plan view of the wiring of the ink jet recording head, which is on the substrate of the recording head.

However, the method which disposes the ink ejection outlets 114 in the zigzag pattern as shown in FIGS. 13A and 13B is problematic in that in order to increase an ink jet recording head in ink ejection outlet density, the dedicated ink passage 119*b* of each of the second nozzles 105*b* has to be reduced in width.

Reducing the dedicated ink passage 119*b* of the second nozzle 105*b* increases the dedicated ink passage 119*b* in viscous resistance D (value of which can be calculated using mathematical equation 1 given below). Thus, it reduces the nozzle 105*b* in response speed, making it difficult to increase the ink jet recording head in recording speed.

$$D = \eta \int_0^1 \frac{G(x)}{S(x)^2}\, dx$$

η: viscosity of liquid

S(X): size of cross-section of given point of dedicated ink passage 119*b*

G(X): shape factor of given point of dedicated ink passage 119*b*

1: length of dedicated ink passage 119*b*

One of the methods for increasing in size the cross-section of the ink delivery passage 19*b* for the second nozzle 105*b* is to form the heater 111 and bubble generation chamber 112 of the first nozzle 105*a* so that the heater 111 is rectangular, as seen from the direction perpendicular to the primary surface of the substrate, and also, so that the bubble generation chamber 120 is rectangular in the vertical cross-section. It is possible that the employment of this method will prevent the problem that increasing an ink jet recording head in nozzle density reduces the recording head in response speed. However, this solution has its own problem. That is, if the heater 111 is made rectangular, and the bubble generation chamber 120 of the second nozzle 105*b* is formed so that not only is its vertical cross-section rectangular, but also, it is extremely long and narrow, air bubbles are liable to collect in the bubble generation chamber 120. As air bubbles collect in the bubble generation chamber 120, they cause the ink jet recording head to erroneously jet ink. That is, they cause the ink jet recording head to change in the shape in which the ink jet recording head jets ink droplets, causing thereby such a problem as the increase in the number by which satellite ink droplets are produced.

SUMMARY OF THE INVENTION

Thus, the primary object of the present invention is to solve the above described problems to make it possible to provide a high speed liquid ejecting head which is significantly higher in nozzle response, being therefore significantly higher in recording speed and image quality than a high speed liquid ejecting head in accordance with the prior art.

According to an aspect of the present invention, there is provided a liquid ejecting head comprising a plurality of nozzles each including an ejection outlet for ejecting a droplet, an ejection energy generating element, disposed at a position opposing said ejection outlet, for generating energy for ejecting a droplet, a pressure chamber provided with said ejection energy generating element and fluidly communicating with said ejection outlet, and a supply passage for supplying the liquid to said pressure chamber, wherein said nozzles include a first nozzle and a second nozzle which are connected with respective ones of said supply passages having lengths different from each other, wherein said first nozzle and said second nozzle are disposed at one end portion with respect to a widthwise direction of an elongated supply chamber for supplying the liquid to said first nozzle, wherein said supply passage for said first nozzle extends in a direction perpendicular to a direction of liquid ejection from said ejection outlet and fluidly communicates with said supply chamber, and wherein said supply passage for said first nozzle extends in a direction parallel with the direction of liquid ejection.

According to the present invention, the first nozzle is in connection to the common ink supply chamber, and extends in the direction perpendicular to the liquid ejecting direction, whereas the second nozzle is extended in the direction parallel to the ink ejecting direction, making it possible to dispose multiple nozzles at a significantly higher level of density than the level of density at which nozzles are disposed in a comparable ink jet recording head in accordance with the prior art, without reducing the ink jet recording head in nozzle response. Therefore, the present invention can significantly increase an ink jet recording head (apparatus) in recording speed, compared to a comparable ink jet recording head in accordance with the prior art.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 4A is a schematic drawing of the nozzle structure of the ink jet recording head in the first embodiment of the present invention, and FIG. 4B is a cross-section thereof.

DETAILED DESCRIPTION OF THE PREFERRED EMBODIMENTS

Hereinafter, the preferred embodiments of the present invention will be described in detail with reference to the appended drawings.

<Ink Jet Printer>

Figure 1:
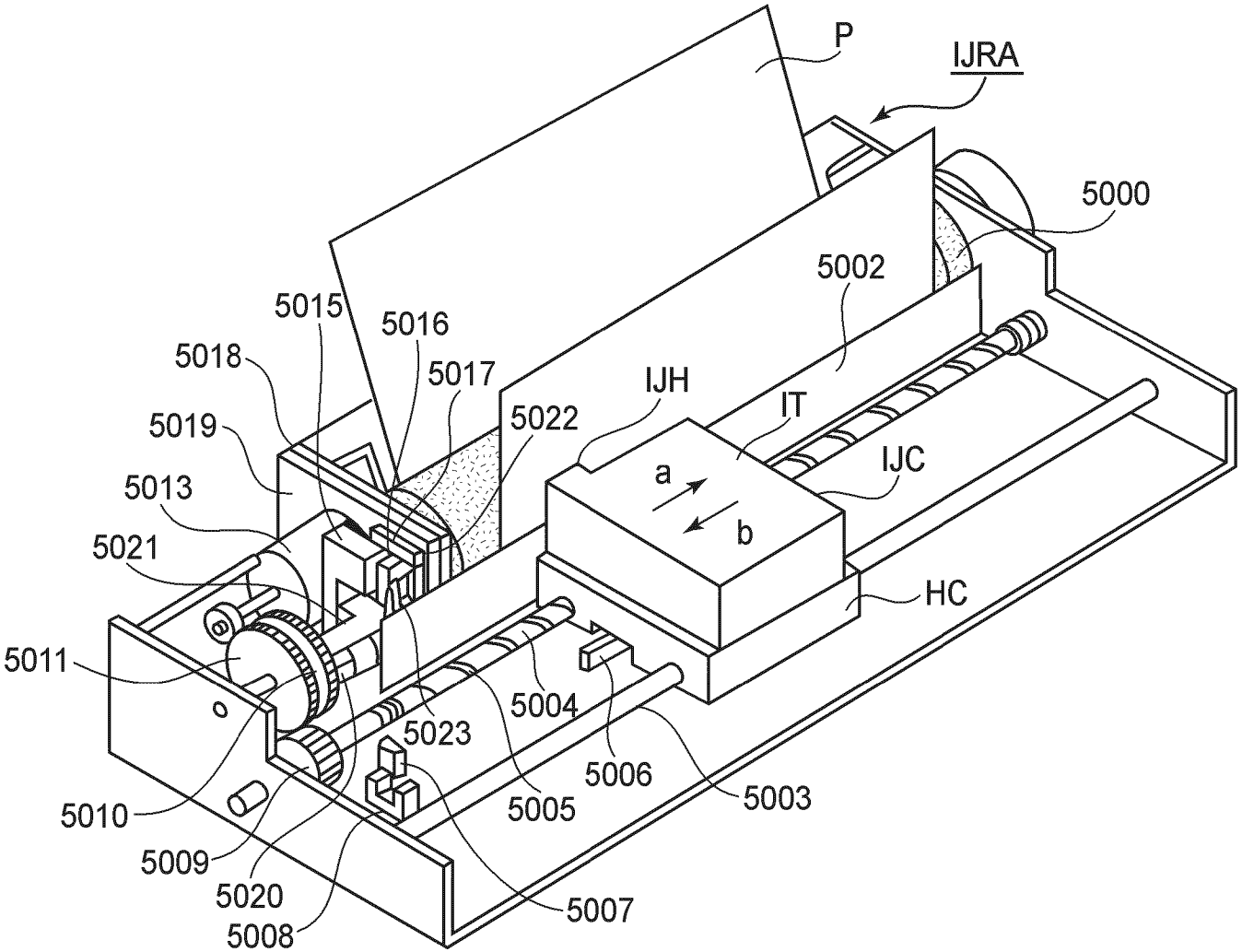
FIG. 1 is a perspective view of a typical ink jet printer in accordance with the present invention, showing the structure of the apparatus.

FIG. 1 is a perspective view of a typical ink jet printer in accordance with the present invention, and shows the structure of the apparatus.

As will be evident from FIG. 1, an ink jet printer IJRA is provided with a carriage HC for moving the recording head IJH across the recording medium P, such as a piece of recording paper, in a manner to scan the surface of the recording medium P. The carriage HC has a pin (unshown) which fits in a spiral groove 5005 of a lead screw 5004 which is rotated forward or backward by the forward or backward rotation of the motor 5013, through driving force transmission gears 5009-5011. The carriage HC is movably supported by a guide rail 5003. As a lead screw 5005 is rotationally driven, the carriage HC reciprocally moves in the direction indicated by an arrow mark a or the direction indicated by an arrow mark b. This carriage HC holds the ink jet cartridge IJC on its top surface. The ink jet cartridge IJC is an integral combination of the recording head IJH and ink container IT.

The ink jet printer IJRA is also provided with a paper pressing plate 5002, which presses the recording medium P upon a platen 5000, across the entire range of the recording medium P in terms of the moving direction of the carriage HC. Further, the ink jet printer IJRA is provided with a pair of photo-couplers 5007 and 5008, which are home position detecting devices and are used to detect the presence of the lever 5006*b* of the carriage HC to switch the direction in which the motor 5013 is to be rotated, or the like purposes.

Further, the ink jet printer IJRA is provided with a recovery unit which restores the ink jet printer IJRA in ink ejecting performance by suctioning the ink in the ink jet recording head of the ink jet printer IJRA through the opening 5023 of a recording head capping member 5022. The recovery unit has: the capping member 5022 for covering the ink ejecting side of the recording head IJH; a capping member supporting member 5016 for supporting the capping member 5022; and a suctioning device 5015 for reducing the internal pressure of the capping member 5022. The recovery unit also has: a cleaning blade 5017 for wiping away the ink having adhered to the ink ejecting side of the recording head IJH; and a supporting member 5019 which supports the blade 5017 in such a manner that the blade 5017 can be moved forward or backward. The recovery unit is supported by a chassis 5018. The blade 5017 for the recovery unit, and the structure for supporting the blade 5017, do not need to be limited to those described above. Obviously, any of the known ink jet head cleaning blades compatible with this embodiment of the present invention may be employed instead of the blade 5017. The recovery unit is also provided with a lever 5021, which is for starting the operation for suctioning the ink in the ink jet recording head to restore its performance. The lever 5021 is moved by the movement of a cam 5020 which is in engagement with the carriage HC. The movement of the lever 5021 is controlled by the driving force transmitted from a motor to the lever 5021 through one of known mechanical power transmitting mechanisms, such as a clutch.

The ink jet printer IJRA is structured so that the abovementioned capping operation, cleaning operation, and suction-based performance recovery operation of the recovery unit are carried out by rotationally driving the lead screw 5004 while the carriage HC is in its home range (area in the adjacencies of home position), into which the carriage HC is moved by the lead screw 5004, at the points which correspond to the above-mentioned operations, respectively. Incidentally, the recovery unit structure does not need to be limited to the recovery unit structure described above; any recovery unit structure may be employed as long as the above-mentioned operations can be carried out with the known timing.

<Control System>

Next, the structure of the control system for controlling the recording operation of the above described ink jet printer will be described.

Figure 2:
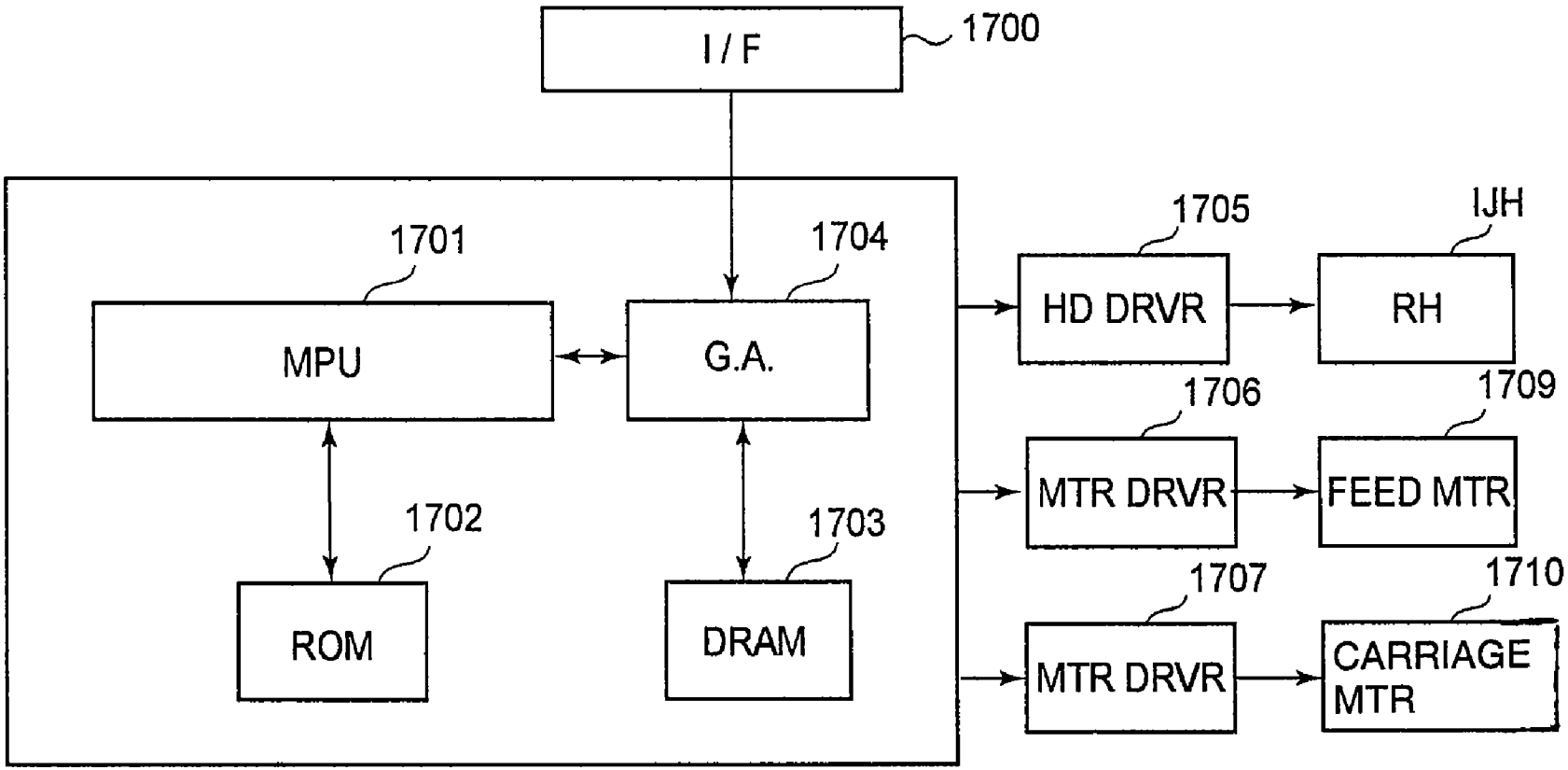
FIG. 2 is a block diagram of the ink jet printer.

FIG. 2 is a block diagram of the control circuit of the ink jet printer IJRA, and shows the structure of the circuit. As will be evident from FIG. 2, the control circuit has: an interface 1700 through which recording signals are inputted; and a MPU 1701 (Micro Processing Unit) which functions as a logic circuit. The control circuit also has: a ROM 1702 in which the control programs which the MPU 1001 performs are stored; a DRAM 1703 in which various data (recording signals, recording data to be supplied to recording head IJH, and the like) are stored. Further, the control circuit has a gate array 1704 (G.A.) which controls the operation for outputting recording data to the recording head IJH. The gate array 1704 also controls the operation for transferring data among the interface 1700, MPU 1701, and RAM 1703.

The control circuit controls the driving of the recording head IJH through a head driver 1705 for driving the recording head IJH. It also controls the driving of a carrier motor 1701 for conveying the recording head IJH, and the driving of a conveyer motor 1709 for conveying the recording medium P, through motor drivers 1706 and 1707, which drive the conveyer motor 1709 and carrier motor, respectively.

Next, the operation of the above described control circuit will be described. As recording signals are inputted into the control circuit through the interface 1700, they are converted into the recording data for a printer, between the gate array 1704 and MPU 1701. Then, the motor drivers 1706 and 1707 are driven, and the recording head IJH is driven according to the recording data sent to the head drivers 1705. As a result, an image is formed on the recording medium P.

Next, the ink jet recording head IJH will be described. Of the aforementioned two types of an ink jet recording head, this ink jet recording head IJH is a recording head which has ink ejecting energy generating elements for generating the thermal energy for ejecting liquid ink from the ink jet recording head. This ink jet recording head IJH uses ink ejecting energy generating elements to generate thermal energy, and uses the thermal energy to change ink in phase. With the employment of this ink ejecting method, this ink jet recording head IJH can achieve significantly higher level of image density and significantly higher level of precision, at which a text or image is recorded, than a comparable ink jet recording apparatus in accordance with the prior art. In particular, in this embodiment, electrothermal transducers are employed as the ink ejecting energy generating elements for generating thermal energy. That is, ink is jetted by utilizing the pressure which generates when a bubble generates as ink is instantaneously boiled (film boiling) by the heat generated by the electrothermal transducers.

First the general structure of the ink jet recording head in this embodiment will be described.

Figure 3A:
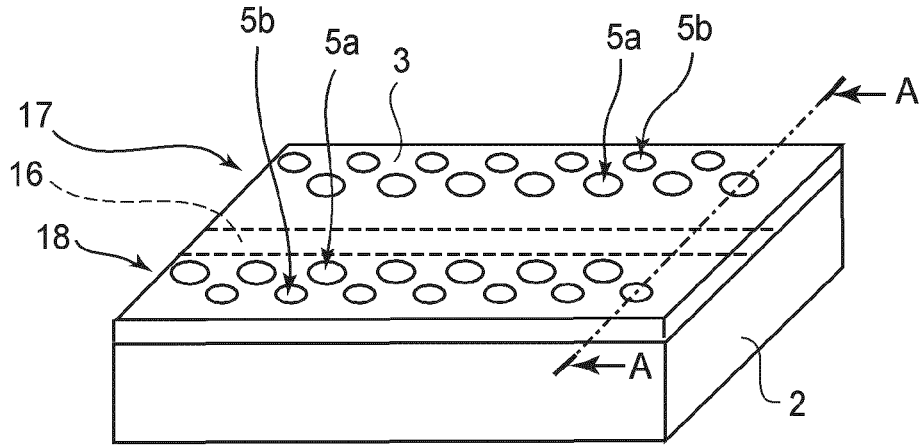
FIG. 3A is a schematic drawing of a typical ink jet recording head in accordance with the present invention.
Figure 3B:
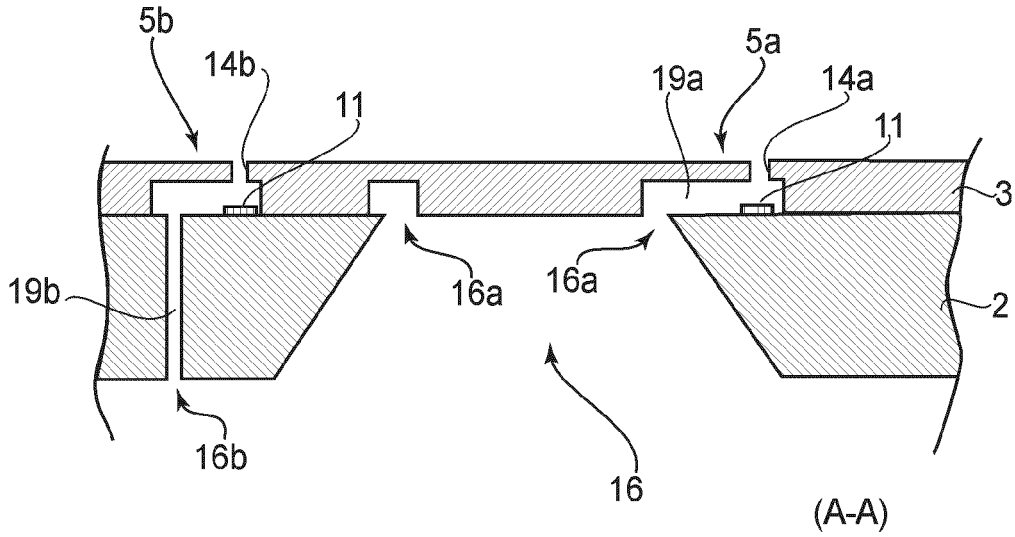
FIG. 3B is a cross-section thereof.

FIG. 3A is a schematic drawing of a typical ink jet recording head in accordance with the present invention. FIG. 3B is a sectional view of the ink jet recording apparatus, at a plane A-A shown in FIG. 3A.

Referring to FIGS. 3A and 3B, the ink jet recording head is provided with: a substrate 2, on which heaters 11 (heat generating resistor), which are electrothermal transducers, have been formed; and an ink passage plate 3 (orifice plate), which is bonded to the substrate 2 to form ink passages.

The substrate 2 may be formed of glass, ceramic, resin, metal, or the like, for example. However, generally, it is formed of Si. There are the heaters 11 and wiring electrodes (unshown), on the primary surface of the substrate 2. The wiring electrodes are for applying voltage to the heaters 111. The heaters 11 and wiring electrodes are directly formed on the primary surface of the substrate 2. Each heater 11 is covered with dielectric film (unshown) for improving heat dispersion, and the dielectric film is covered with protective film (unshown) for protecting the heater 11 (dielectric film) from cavitation. Further, the ink passage plate 3 for forming the nozzles, etc., is formed of metal, polyimide, polysulfone, or epoxy resin, for example.

Referring again to FIGS. 3A and 3B, the ink jet recording head has: multiple heaters 11; multiple nozzles 5*a* each having an ink ejection outlet 14*a* through which ink droplets are jetted; and multiple nozzles 5*b* each having an ink ejection outlet 14*b* through which ink droplets are jetted. More specifically, there are two sets of nozzles 5*a*, and two sets of nozzles 5*b*. One set of nozzles 5*a* is on one side of the common ink supply chamber 16 and the other set of nozzles 5*a* is on the other side of the common ink supply chamber 16. Further, one set of nozzles 15*b* is on one side of the common ink supply chamber 16, and the other set is on the other side of the common ink supply chamber 16. Further, the nozzles 5*a* and 5*b*, which are on one side of the common ink supply chamber 16 in terms of the direction parallel to the shorter edges of the common ink supply chamber 16, make up the first column 17 of nozzles, whereas the nozzles 5*a* and 5*b*, which are on the other side of the common ink supply chamber 16, make up the second column 18 of nozzles.

FIGS. 4A and 4B are schematic drawings of the ink jet recording head in the first embodiment, and show the structure of the nozzles. FIG. 4A is a phantom plan view of a part of the ink jet recording head, as seen from the direction perpendicular to the primary surface of the substrate 2. FIG. 4B is a sectional view of the ink jet recording head, at a plane B-B shown in FIG. 4A.

Referring to FIG. 4A, each heater 11 is in the bubble generation chamber 20 (pressure chamber) formed by the substrate 2 and ink passage plate 3. It is on the primary surface of the substrate 2. The ink jet recording head has multiple separation walls which separate the adjacent two dedicated ink passages 19*a* from each other. Each separation wall extends from the corresponding bubble generation chamber 20 to the adjacencies of the common ink supply chamber 16. Referring to FIG. 4B, the top wall of the bubble generation chamber 20 is provided with the ink ejection outlet 14*a*, which aligns with the heater 11 in terms of the direction perpendicular to the primary surface of the substrate 2.

The dedicated ink passage 19*a* is on the inward side of the bubble generation chamber 20 of the first nozzle 5*a*, and is in connection to the first common ink channel 16*a*. The lengthwise direction of the dedicated ink passage 19*a* of the first nozzle 5*a* is perpendicular to the direction in which ink is jetted from the ink ejection outlet 14*a*. The dedicated ink passage 19*b*, which is in connection to the second common ink channel 16*b*, is on the outward side of the bubble generation chamber 20 of the second nozzle 5*b*. The lengthwise direction of the dedicated ink passage 19*b* of the second nozzle 5*b* is parallel to the direction in which ink is jetted from the ink ejection outlet 14*b*.

In the case of the first nozzle 5*a*, the ink supplied to the common ink supply chamber 16 from an ink container is supplied to the dedicated ink passage 19*a* through the first common ink channel 16*a* of the common ink supply chamber 16. In the case of the second nozzle 5*b*, ink is supplied from the ink container to the dedicated ink passage 19*b* through the second common ink channel 16*b*, without going through the common ink supply chamber 16.

Structuring the ink jet recording head as described above makes it possible to leave satisfactorily large the width of the dedicated ink passage 19*a* of the first nozzle 5*a* and the width of the dedicated ink passage 19*b* of the second nozzle 5*b*, while making significantly higher the density of the ink ejection outlet 14*a* of the first nozzle 5*a* and the density of the ink ejection outlet 14*b* of the second nozzle 5*b* than a comparable ink jet recording head in accordance with the prior art. In other words, it makes it possible to eliminate the problem that disposing ink ejection outlets (nozzles) at a high level of density increases the viscous resistance of each of the dedicated ink passages. Therefore, it makes it possible to provide an ink jet recording head which is high in nozzle response, being therefore capable of recording at a high speed.

Incidentally, in this embodiment, the dedicated ink passage 19*b* for the second nozzle 5*b* is not in connection to the common ink supply chamber 16. However, this structural arrangement is not intended to limit the present invention in scope. That is, the ink jet recording head may be structured so that the first and second nozzles 5*a* and 5*b* are both in connection to the common ink supply chamber 16.

Hereafter, the nozzles of the ink jet recording head, which are the essential portions of the recording head, will be described about their structure, with reference to some of the preferred embodiments of the present invention.

Embodiment 1

Figure 5A:
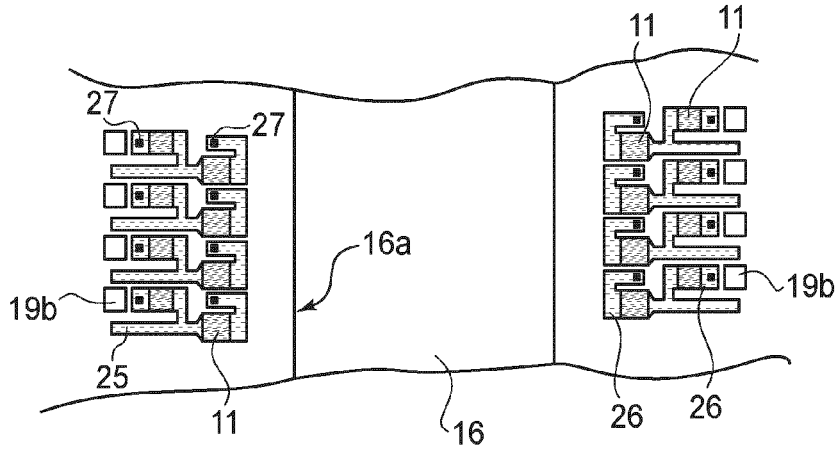
FIGS. 5A and 5B are schematic drawings of the wiring of the ink jet recording head in the first embodiment, which is on the substrate of the head.
Figure 5B:
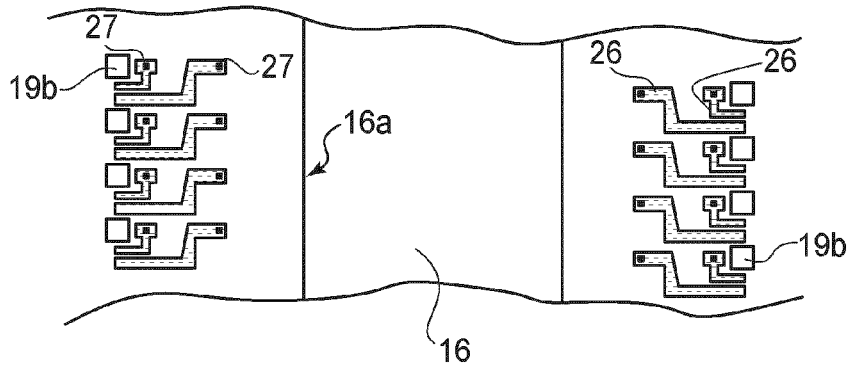

FIG. 5A is a schematic drawing of the wiring on the substrate 2 of ink jet recording head chip. FIG. 5B is a schematic drawing of the wiring on the substrate 2, which is different in position, in terms of the thickness direction of the substrate 2, from the wiring shown in FIG. 5B (wiring on back side of substrate 2 from wiring shown in FIG. 5A. The common wiring 25 shown in FIG. 5A is in electrical connection to the dedicated wiring 26, shown in FIG. 5B, which is different in position from the common wiring 25 in terms of the thickness direction of the substrate 2, through the contact hole 27 (through hole) shown in FIG. 5A.

In this embodiment, the first nozzle column 17 is on one side of the long and narrow common ink supply chamber 16, in terms of the direction parallel to the shorter edges of the common ink supply chamber 16, and the second nozzle column 18 is on the other side. Referring to FIG. 4A, the ink ejection outlets 14*a* and 14*b* of the nozzle column 17, and the ink ejection outlets 14*a* and 14*b* of the nozzle column 18, are arranged so that in terms of the direction parallel to the longer edges of the common ink supply chamber 16, each ink ejection outlet 14*a* corresponds in position to the mid point between the two ink ejection outlets 14*b* adjacent to the hole 14*a*; they are arranged in a zigzag pattern. Further, the ink ejection outlets 14*a* and 14*b* of the nozzle column 17, and the ink ejection outlets 14*a* and 14*b* of the second nozzle column 18, are aligned so that the distance between the adjacent two ink ejection outlets 14*a*, and the distance between the adjacent two ink ejection outlets 14*b*, correspond to a resolution of no less than 1,200 dpi (no less than 21.2 μm), and also, so that in terms of the direction perpendicular to the longer edges of the common ink supply chamber 16, the distance between the adjacent ink ejection outlet 14*a* and 14*b* of the first nozzle column 17, and the distance between the adjacent ink ejection outlet 14*a* and 14*b* of the second nozzle column 18, also corresponds to a resolution of 1,200 dpi. That is, in terms of the direction parallel to the longer edges of the common ink storage chamber, an ink ejection outlet 14*a* is staggered in position from the corresponding ink ejection outlet 14*b*.

In this embodiment, the ink ejection outlet 14*a* of the first nozzle 5*a* is 12 μm in diameter. The heater 11 of the first nozzle 5*a* is square and is 22 μm in the length of each edge. Further, the bubble generation chamber 20 of the first nozzle 5*a* is a rectangular parallelepipedic space which is 26 μm, 26 μm, and 14 μm in length, width, and height, respectively. The dedicated ink passage 19*a* of the first nozzle 5*a* is a rectangular parallelepipedic space which is 21 μm, 10 μm, and 14 μm in length, width, and height, respectively. On the other hand, the ink ejection outlet 14*b* of the second nozzle 5*b* is 9 μm in diameter. The heater 11 of the second nozzle 5*b* is square and is 17 μm in the length of each edge. Further, the bubble generation chamber 20 of the second nozzle 5*b* is a rectangular parallelepipedic space which is 24 μm, 50 μm, and 14 μm in length, width, and height, respectively. The dedicated ink passage 19*b* of the second nozzle 5*b* is a rectangular parallelepipedic space which is 17 μm, 17 μm, and 320 μm in length, width, and height, respectively.

The ink droplet jetted out of the first nozzle 5*a* is roughly 2.5 μl in volume V1, and roughly 14 msec in speed. The response frequency f1 of the first nozzle 5*a* is roughly 25 kHz. "Response frequency" means the frequency value at which the amount of deviation from the referential frequency becomes roughly 70%. The ink droplet jetted out of the second nozzle 5*b* is roughly 1.5 μl in volume V2, and roughly 14 msec in speed. The response frequency f2 of the second nozzle 5*b* is roughly 20 kHz. In this embodiment, therefore, the relationship between the volume V1 of the ink droplet jetted out of the first nozzle 5*a* and the volume V2 of the ink droplet jetted out of the second nozzle 5*b* satisfies an inequity of V1>V2. Further, the relationship between the response frequency f1 of the first nozzle 5*a* and the response frequency f2 of the second nozzle 5*b* satisfies an inequity of f1>f2.

Figure 13A:
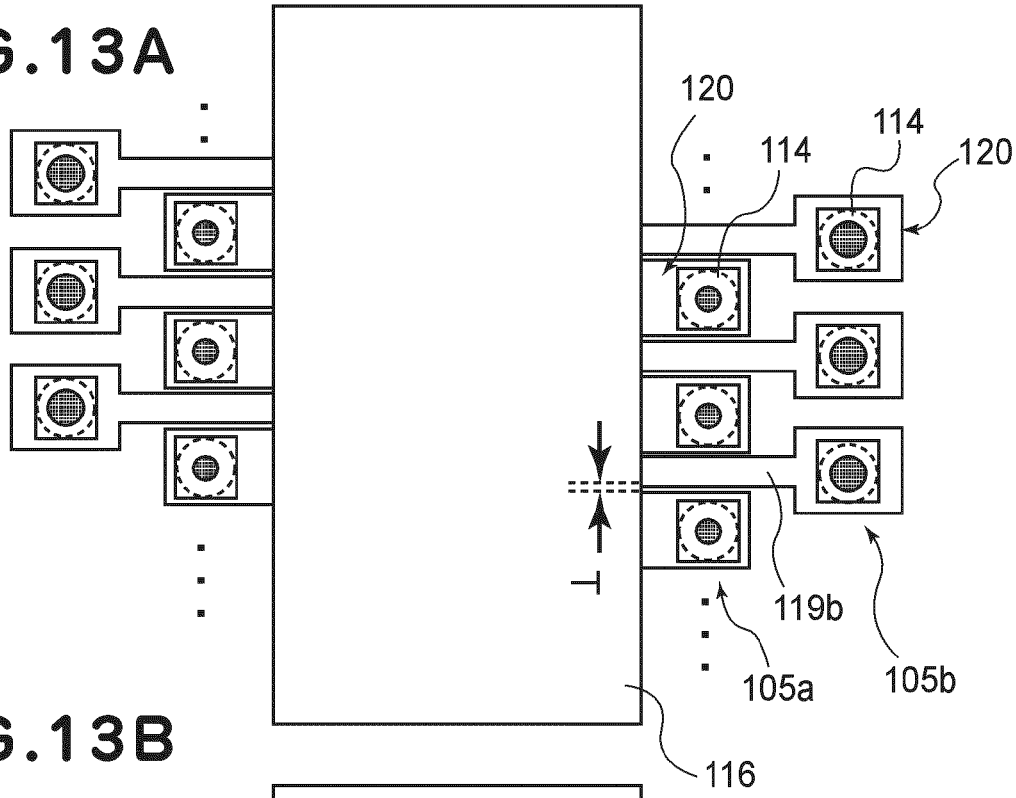
FIGS. 13A and 13B are phantom plan views of a part of the typical ink jet recording head in accordance with the prior art, which is comparable to the ink jet recording head in accordance with the present invention, showing the multiple nozzles of the part.
Figure 13B:
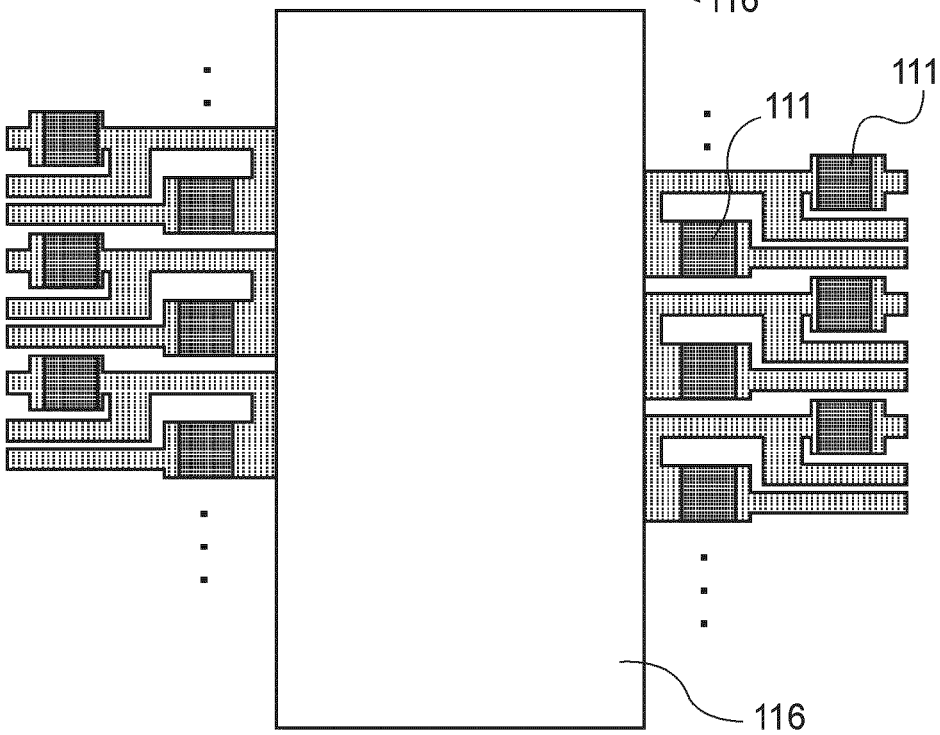

In this embodiment, the wiring of the ink jet recording head is formed as shown in FIGS. 5A and 5B, therefore, the wiring is roughly the same in size as that of a comparable ink jet recording head in accordance with the prior art, which is shown in FIGS. 13A and 13B.

In the case of the nozzle structure shown in FIG. 13A, if an attempt is made to achieve the roughly the same level of performance as that of the ink jet recording head in this embodiment, the clearance T between the bubble generation chamber of the first nozzle 105*a* and the dedicated ink passage of the second nozzle 105*b* has to be no more than 4 μm. However, in consideration of the fastness of the bond between the ink passage plate (orifice plate) and substrate, it is very difficult to achieve the clearance T of no more than 4 μm.

As described above, in the case of the ink jet recording head in this embodiment, the dedicated ink passage 19*a* of the first nozzle 5*a* is in contact with the common ink supply chamber 16, and its lengthwise direction is perpendicular to the direction in which ink is jetted, whereas the lengthwise direction of the dedicated ink passage 19*b* of the second nozzle 5*b* is parallel to the direction in which ink jetted. This structural arrangement can eliminate the problem that arranging the first and second nozzles 5*a* and 5*b* at a high density requires the dedicated ink passage of the second nozzle 5*b* to be made narrower. Therefore, it makes it possible to provide an ink jet recording head which is no lower in nozzle response speed, while being significantly high in the density at which its nozzles 5*a* and 5*b* are disposed, and yet, is higher in recording speed than a comparative ink jet recording head in accordance with the prior art.

Next, the other embodiments of the present invention will be described. For convenience, the portions of each of the ink jet recording heads in the following embodiments of the present invention, which are the same as the counterparts of the ink jet recording head in the first embodiment, are given the same referential symbols as those given to the counterparts, one for one.

Embodiment 2

Figure 6:
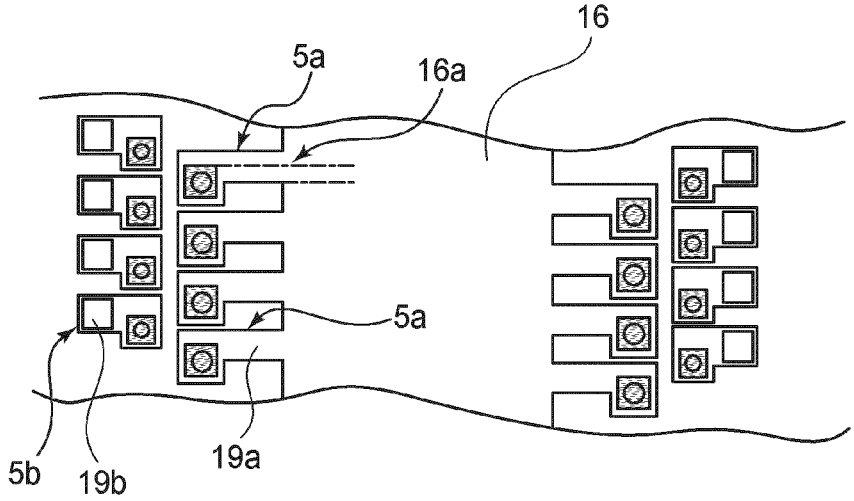
FIG. 6 is a phantom plan view of a part of the ink jet recording head in the second embodiment of the present invention, showing the nozzle structure thereof.

FIG. 6 is a phantom plan view of a part of the ink jet recording head in the second embodiment of the present invention, as seen from the direction perpendicular to the top surface of the ink passage plate 3, and shows the nozzle structure of the recording head. Next, referring to FIG. 6, the specific differences of the ink jet recording head in this embodiment from the ink jet recording head in the first embodiment will be described.

Referring to FIG. 6, in this embodiment, the centerline of the dedicated ink passage 19*a* of the first nozzle 5*a* is offset from the center of the primary surface of the heater 11, in terms of the direction parallel to the nozzle columns. Positioning the dedicated ink passage 19*a* of the first nozzle 5*a* as shown in FIG. 6 relative to the heater 11 causes ink to circularly flow about the axial line of the ink ejection outlet 14, as disclosed in Japanese Laid-open Patent Application 2002-321369. That is, with the ink jet recording head structured as described above, even if a bubble generated by the heater 11 of the first nozzle 5*a* fails to come into contact with the ambient air, the circular flow of ink about the axial line of the ink ejection outlet 14*a* of the first nozzle 5*a* makes the ink jet recording head unstable in the point at which a bubble collapses, and therefore, the wiring is prevented from being broken by cavitation. The characteristics of the nozzles 5*a* and 5*b* in this embodiment are roughly the same as those in the first embodiment.

Embodiment 3

Figure 7A:
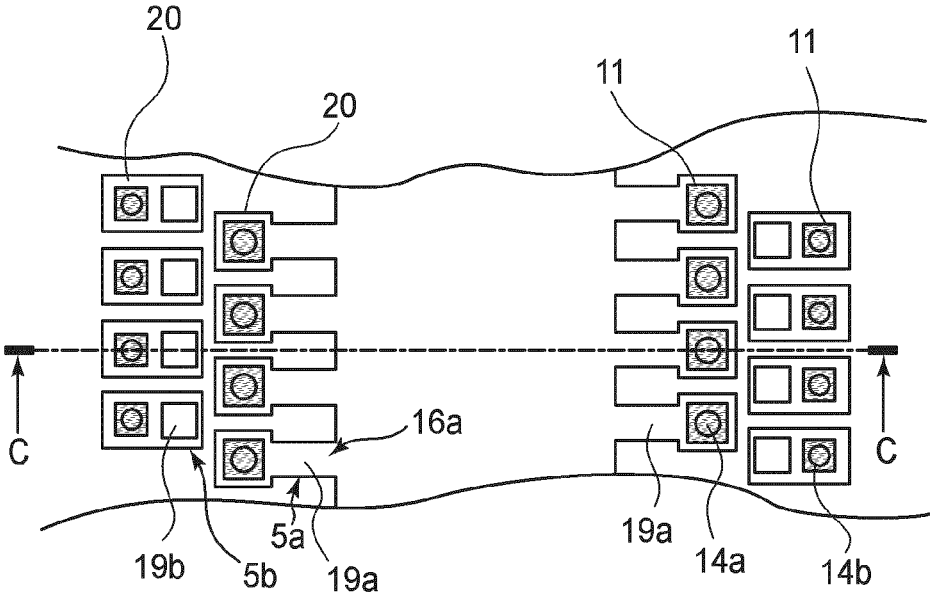
FIG. 7A is a schematic drawing of a part of the ink jet recording head in the third embodiment of the present invention, showing the nozzle structure thereof.
Figure 7B:
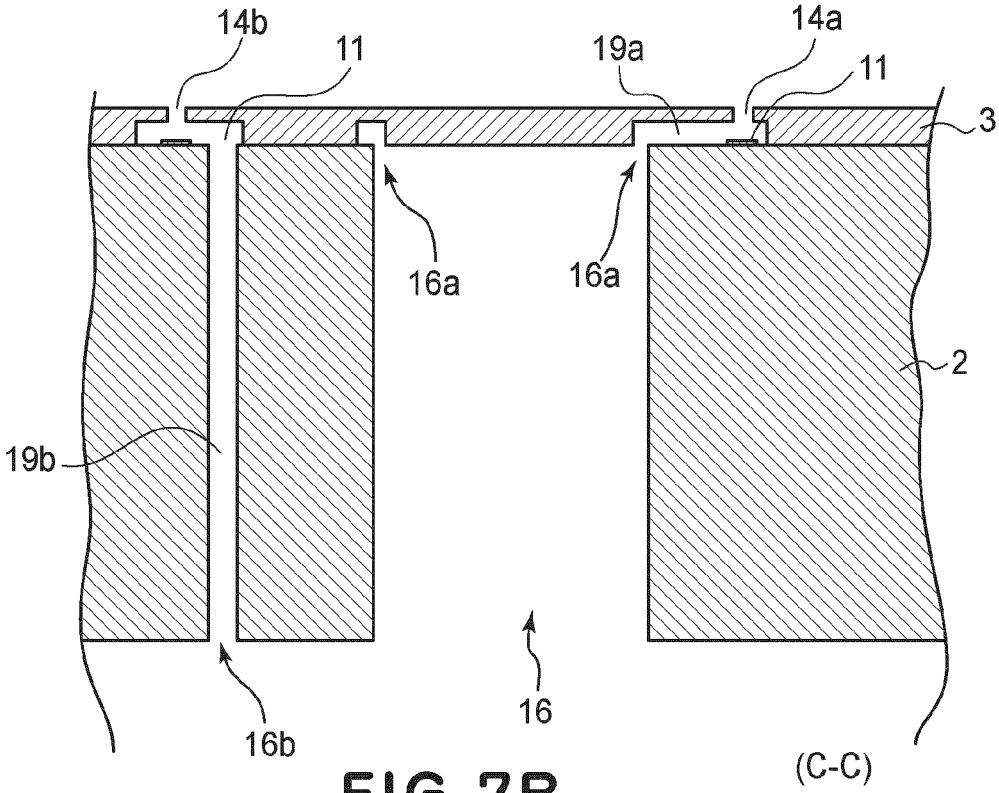
FIG. 7B is a cross-section thereof.

FIGS. 7A and 7B show the nozzle structure of the ink jet recording head in the third embodiment. FIG. 7A is a phantom plan view of a part of the ink jet recording head, as seen from the direction perpendicular to the primary surface of the ink passage plate 3. FIG. 7B is a sectional view of the part of the ink jet recording head shown in FIG. 7A, at a plane C-C shown in FIG. 7A. Next, referring to FIGS. 7A and 7B, the specific differences of the ink jet recording head in this embodiment from the ink jet recording head in the first embodiment will be described.

Referring to FIGS. 7A and 7B, the ink jet recording head in this embodiment is structured so that the positional relationship between the heater 11 of the second nozzle 5*b* and the first nozzle 5*a*, positional relationship between ink ejection outlet 14*b* the second nozzle 5*b* and the first nozzle 5*a*, and positional relationship between the dedicated ink passages 19*b* of the second nozzle 5*b* and the first nozzle 5*a*, are reverse to those in the first embodiment. Positioning the heaters 11, ink ejecting openings 14, and dedicated ink passages 19 as described above makes it possible to increase the distance between the heater 11 of the first nozzle 5*a* and the heater 11 of the second nozzle 5*b*. Thus, the wiring of the ink jet recording head in this embodiment is easier to form than that in the first embodiment. The characteristics of the nozzles 5*a* and 5*b* are roughly the same as those in the first embodiment.

Embodiment 4

Figure 8A:
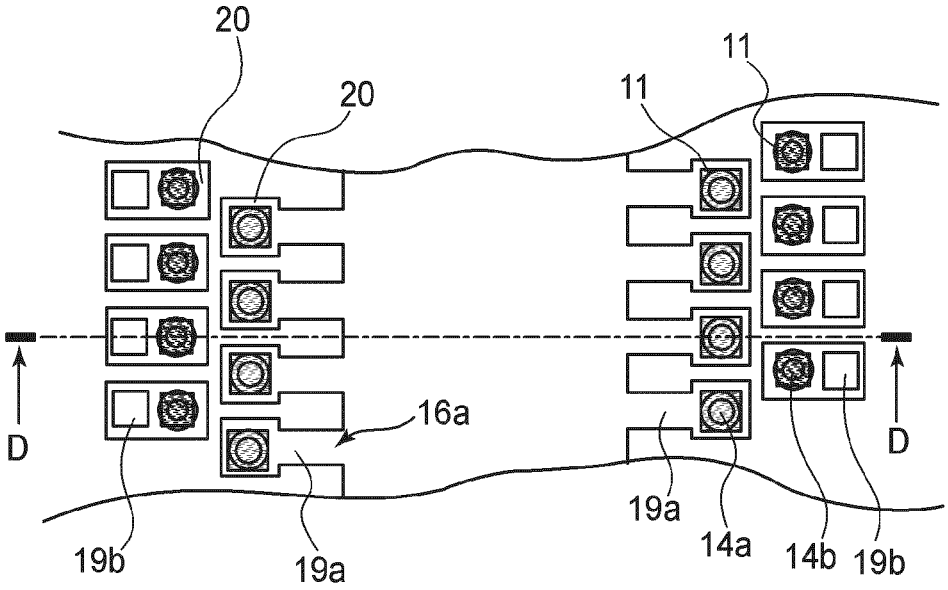
FIG. 8A is a schematic drawing of a part of the ink jet recording head in the fourth embodiment of the present invention, showing the nozzle structure thereof.
Figure 8B:
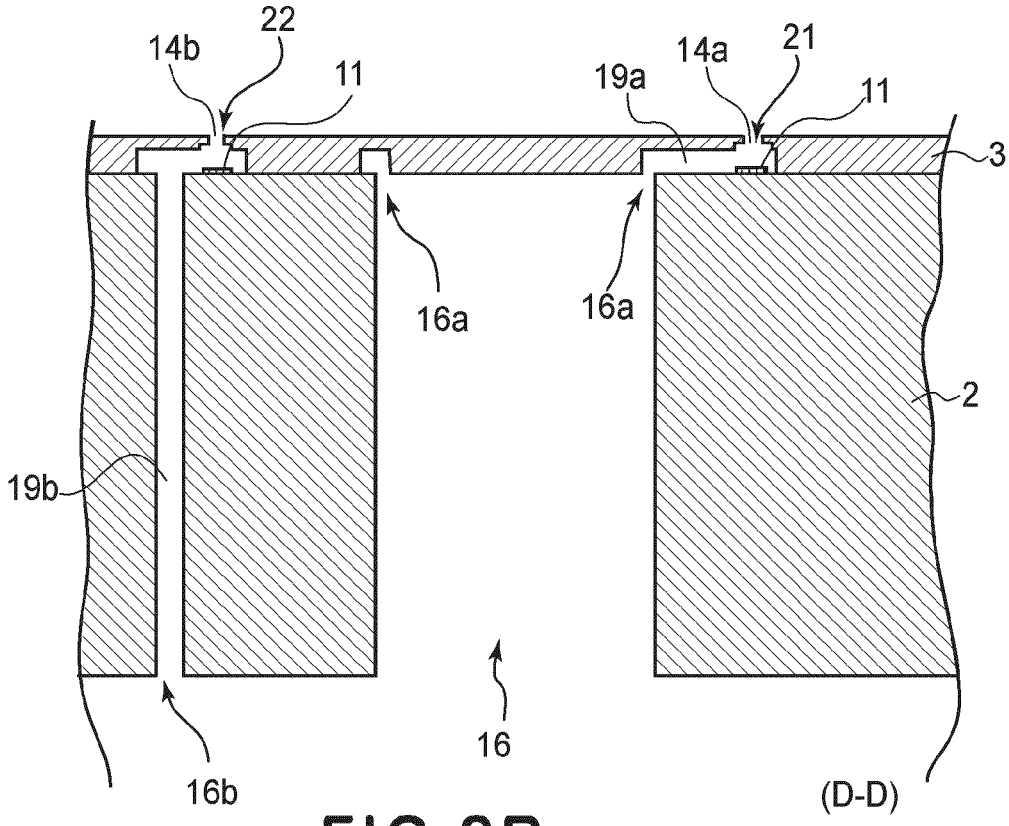
FIG. 8B is a cross-section thereof.

FIGS. 8A and 8B show the nozzle structure of the ink jet recording head in the fourth embodiment. FIG. 8A is a phantom plan view of a part of the ink jet recording head, as seen from the direction perpendicular to the primary surface of the ink passage plate 3. FIG. 8B is a sectional view of the part of the ink jet recording head shown in FIG. 8A, at a plane D-D in FIG. 8A. Next, referring to FIGS. 8A and 8B, the specific differences of the ink jet recording head in this embodiment from the ink jet recording head in the first embodiment will be described.

Referring to FIGS. 8A and 8B, the ink jet recording head in this embodiment is structured so that in terms of the direction parallel to the direction in which ink is jetted, the ink ejection outlets 14*a* and 14*b* of the first and second ink ejecting portions 21 and 22, respectively, of the ink jet recording head are made up of two portions, that is, the outward portion and inward portion, which are different in diameter. Structuring the ink jet recording head so that each of the ink ejection outlets of the first and second ink ejecting portions 21 and 22 of the ink jet recording head has two portions different in diameter reduces the nozzles in forward inheritance, making it possible to reduce in size the heater 11 compared to the one in the first embodiment. In the case of the first and second nozzles 5*a* and 5*b* structured as shown in FIGS. 8A and 8B, the second portion, that is, the inward portion, of the ink ejection outlet 14*a* of the ink ejecting first portion 21 of the first nozzle 5*a*, is 18 μm in diameter, and the second portion of the ink ejection outlet 14*b* of the ink ejecting second portion 22 of the second nozzle 5*b* is 15 μm in diameter. The heater 11 of the first nozzle 5*a* is square and 15 μm in the length of each edge, whereas the heater 11 of the second nozzle 5*b*, which also is square, is 15 μm in the length of each edge. That is, the ink jet recording head in this embodiment is smaller in the size of the heater 11. The characteristics of the nozzles 5*a* and 5*b* in this embodiment are virtually the same as those in the first embodiment.

Embodiment 5

Figure 9A:
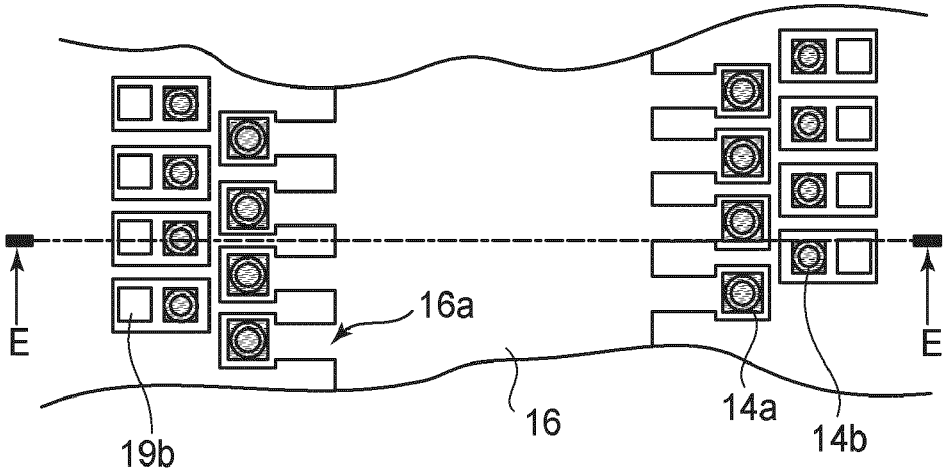
FIG. 9A is a schematic drawing of a part of the ink jet recording head in the fifth embodiment of the present invention, showing the nozzle structure thereof.
Figure 9B:
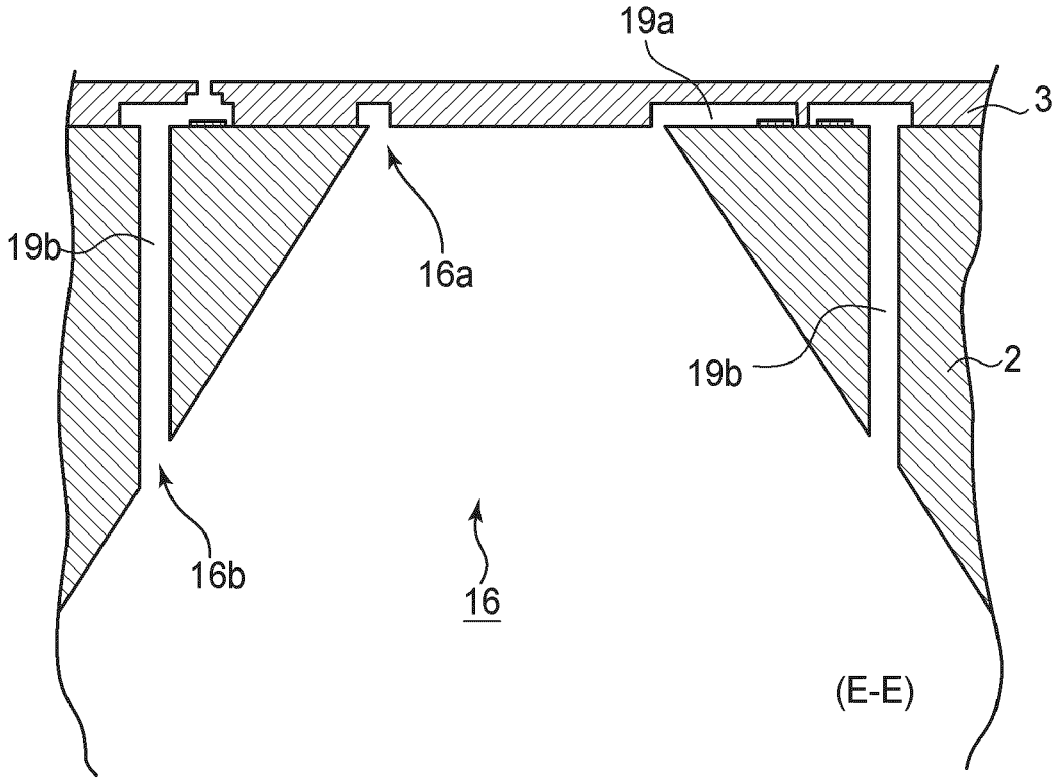
FIG. 9B is a cross-section thereof.

FIGS. 9A and 9B show the nozzle structure of the ink jet recording head in the fifth embodiment. FIG. 9A is a phantom plan view of a part of the ink jet recording head, as seen from the direction perpendicular to the primary surface of the ink passage plate 3. FIG. 9B is a sectional view of the part of the ink jet recording head shown in FIG. 9A, at a plane E-E shown in FIG. 9A. Next, referring to FIGS. 9A and 9B, the specific differences of the ink jet recording head in this embodiment from the ink jet recording head in the fourth embodiment will be described.

Referring to FIGS. 9A and 9B, in this embodiment, the common ink channel 16*a* is formed by joining the ink passage plate 3 with the substrate 2 in which the common ink supply chamber 16 is formed by removing a part of the substrate 2 by anisotropic etching or the like method. Further, the bottom end of the common ink channel 16*b* is open at the slanted surface of the common ink supply chamber 16, which is formed by the anisotropic etching or the like method. Therefore, the dedicated ink passage 19*b* of the second nozzle 5*b* is shorter than the thickness of the substrate 2.

Structuring an ink jet recording head so that its first and second common ink channels 16*a* and 16*b* are like those in this embodiment makes the second nozzle 5*b* faster in response speed than that of the second nozzle 5*b* in the fourth embodiment.

Embodiment 6

Figure 10:
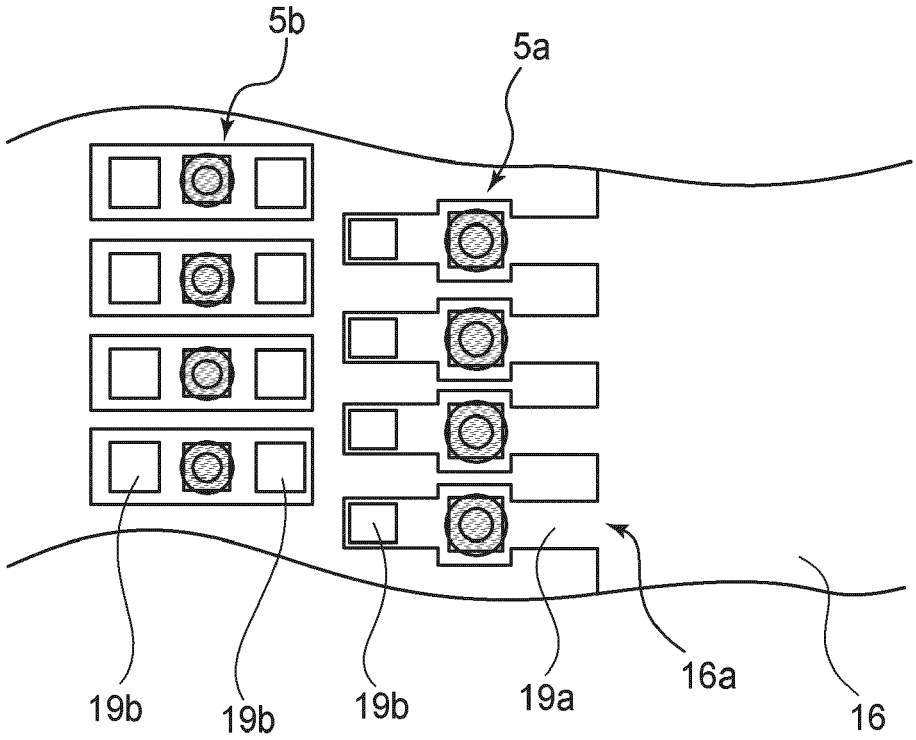
FIG. 10 is a phantom plan view of a part of the ink jet recording head in the sixth embodiment of the present invention, showing the nozzle structure thereof.

FIG. 10 is a phantom plan view of the ink jet recording head in the sixth embodiment, as seen from the direction perpendicular to the ink passage plate 3. Next, referring to FIG. 10, the specific differences of this embodiment from the fourth embodiment will be described.

Referring to FIG. 10, in this embodiment, each of the first nozzles 5*a* has a dedicated ink passage 19*a* which leads to the common ink channel 16*a*, and a dedicated ink passage 19*b* which leads to the common ink channel 16*b*, whereas each of the second nozzles 5*b* has two dedicated ink passages 19*b* which lead to the common ink channel 16*b*.

Providing each of the nozzles 5*a* and 5*b* with multiple (two in this embodiment) dedicated ink passages 19 improves the nozzles 5*a* and 5*b* in response speed, compared to the nozzles 5*a* and 5*b* in the fourth embodiment.

Embodiment 7

Figure 11:
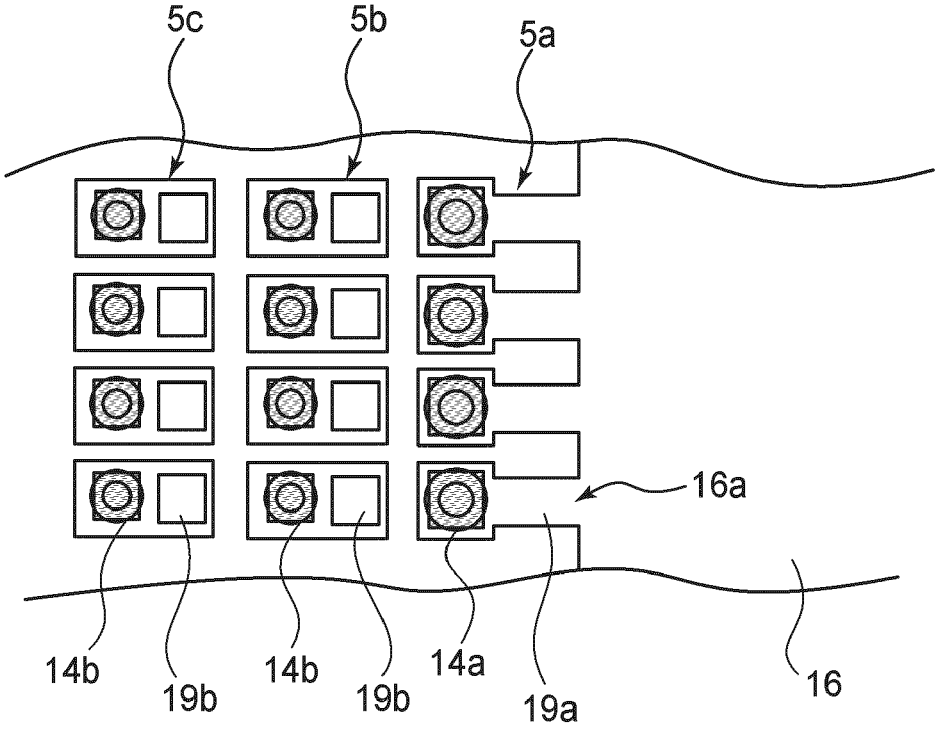
FIG. 11 is a phantom plan view of a part of the ink jet recording head in the seventh embodiment of the present invention, showing the nozzle structure thereof.
Figure 12A:
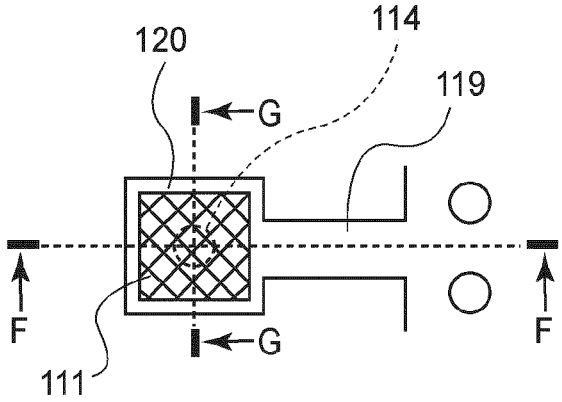
FIG. 12A is a schematic drawing of one of the nozzles of the typical ink jet recording head in accordance with the prior art which is comparable to the ink jet recording head in accordance with the present invention.
Figure 12B:
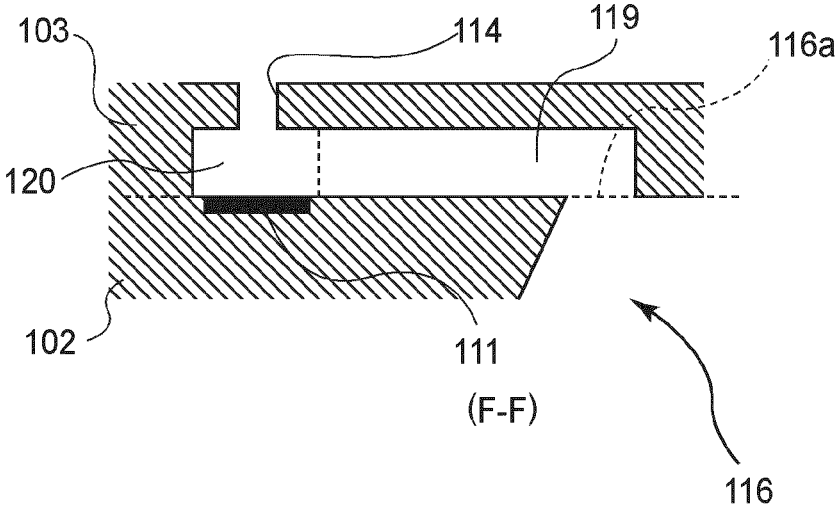
FIGS. 12B and 12C are cross-sections thereof.
Figure 12C:
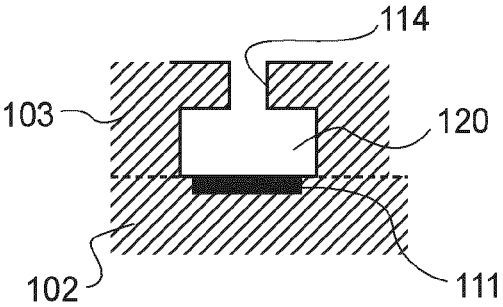

FIG. 11 is a phantom plan view of the ink jet recording head in the seventh embodiment, as seen from the direction perpendicular to the ink passage plate 3. Next, referring to FIG.

11, the specific differences of this embodiment from the fourth embodiment will be described.

Referring to FIG. 11, the ink jet recording head in this embodiment is provided with third nozzles 5*c* in addition to the first and second nozzles 5*a* and 5*b*. The third nozzles 5*c* are different from the first and second nozzles 5*a* and 5*b* in the location of their ink ejection outlets, in terms of the direction parallel to the shorter edges of the top and bottom openings of the common ink supply chamber 16. Like the dedicated ink passage 19*b* of each of the second nozzle 5*b*, the dedicated ink passage 19*b* of each of the third nozzles 5*c* extends in the direction parallel to the direction in which ink is jetted.

The employment of the nozzle structure in this embodiment makes it possible to form an ink jet recording head, a specific portion (or specific portions) of which is higher in nozzle density than the other portions.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 225695/2007 filed Aug. 31, 2007, which is hereby incorporated by reference herein.

What is claimed is:

1. A liquid ejecting head comprising:

a plurality of nozzles, each including an ejection outlet for ejecting a droplet, an ejection energy generating element, disposed at a position opposing said ejection outlet, for generating energy for ejecting a droplet, a pressure chamber provided with said ejection energy generating element and fluidly communicating with said ejection outlet, and a supply passage for supplying the liquid to said pressure chamber, wherein said nozzles include a first nozzle and a second nozzle which are connected with respective supply passages having lengths different from each other, wherein said first nozzle and said second nozzle are disposed at one end portion with respect to a widthwise direction of an elongated supply chamber for supplying the liquid to said first nozzle, wherein a distance between said second nozzle and said supply chamber is greater than that between said first nozzle and said supply chamber, wherein said supply passage for said first nozzle extends in a direction perpendicular to a direction of liquid ejection from said ejection outlet and fluidly communicates with said supply chamber, and wherein said supply passage for said second nozzle extends in a direction parallel to the direction of liquid ejection.

2. A liquid ejection head according to claim 1, wherein a volume of the liquid ejected from said first nozzle is greater than the volume of the liquid ejected from said second nozzle.

3. A liquid ejection head according to claim 2, wherein a response frequency f1 of said first nozzle and a response frequency f2 of said second nozzle satisfy $f1>f2$.

4. A liquid ejection head according to claim 1, further comprising a plurality of first nozzles and a plurality of seconds nozzles, wherein said ejection outlets of said first nozzles and said second nozzles are arranged in a staggered fashion.

5. A liquid ejection head according to claim 1, wherein at least one of said ejection energy generating elements includes a substantially square heat generating resistor.

6. A liquid ejection head according to claim 1, wherein said ejection energy generating elements are disposed so as to provide a density of not less than 1200 dpi with constant intervals in a longitudinal direction of said supply chamber.

7. A liquid ejection head according to claim 1, wherein said first and second nozzles have stepped portions, respectively, to change the inner diameters of said first and second nozzles in the liquid ejecting direction.

8. A liquid ejection head according to claim 1, wherein said first nozzle includes a first supply passage extending in the direction perpendicular to the direction of liquid ejection and fluidly communicating with said supply chamber and a second supply passage extending in a direction in parallel with the direction of liquid ejection.

9. A liquid ejection head according to claim 1, wherein said second nozzle includes a plurality of supply passages extending in parallel with the direction of the liquid ejection.

10. A liquid ejection head according to claim 1, further comprising a third nozzle at a position different, relative to a longitudinal direction of said supply chamber, from a position of said first nozzle and from the position of said second nozzle.

11. A liquid ejection head according to claim 1, wherein said first nozzle and said second nozzle are in fluid communication with said supply chamber.

12. A liquid ejecting head comprising:

a plurality of nozzles, each including ejection outlets, formed in a liquid passage constituting substrate, for ejecting droplets, ejection energy generating elements, formed on an element substrate and disposed at positions opposing said ejection outlets, for generating energy for ejecting droplets, pressure chambers provided with said ejection energy generating elements and fluidly communicating with said ejection outlets, and supply passages for supplying the liquid to said pressure chambers, wherein said nozzles include first nozzles and second nozzles which are disposed at one end portion of a supply chamber extending in a direction in which said first and second nozzles are arranged, said supply chamber supplying the liquid to said first nozzles, wherein a distance between said second nozzle and said supply chamber is greater than that between said first nozzle and said supply chamber, and wherein said supply passages for said first nozzles are disposed along a surface of said element substrate between said liquid passage constituting substrate and said element substrate, and said supply passages for said second nozzles penetrate through said element substrate.

* * * * *